United States Patent [19]

Heuck

[11] 4,346,507

[45] Aug. 31, 1982

[54] PIN-BACK BUTTON MACHINE

[76] Inventor: Oran H. Heuck, P.O. Box 68053, Indianapolis, Ind. 46268

[21] Appl. No.: 226,851

[22] Filed: Jan. 21, 1981

[51] Int. Cl.[3] ..... B23P 11/00

[52] U.S. Cl. ..... 29/243.52

[58] Field of Search ..... 29/243.5, 243.52

[56] References Cited

U.S. PATENT DOCUMENTS 4,299,019 11/1981 Roebuck ..... 29/243.52

3,795,036 3/1974 Roebuck ..... 29/243.52

*Primary Examiner*—James L. Jones, Jr.

*Attorney, Agent, or Firm*—Frost & Jacobs

[57] ABSTRACT

A die assembly for making a pin-back button is taught. The die assembly comprises a base die part, a crimping die part, a ring die part and a top die part. Each die part is mountable on the next in the order given to form the die assembly. Cooperating means are provided on the base die part and crimping die part and on the ring die part and top die part to determine the depth to which the base die part enters the crimping die part and the top die part enters the ring die part. Each die part is rotatable with respect to that die part on which it is mounted to bring selected ones of the cooperating means into and out of registry to enable each die part to perform its functions in proper sequence to assemble a pin-back button.

21 Claims, 22 Drawing Figures

PIN-BACK BUTTON MACHINE

TECHNICAL FIELD

The invention relates to an improved die assembly for making a pin-back button, and more particularly to such a die assembly wherein the die parts are rotatable with respect to each other to preselected positions of alignment so that each die part can perform its functions in proper sequence.

BACKGROUND ART

Prior art workers have devised numerous types of pin-back button making machines. A usual form of button making machine requires five die parts, making up a die assembly. The various steps in the assembly of the pin-back button require from 3 to 4 of the die parts. The manipulative steps require frequent assembly and disassembly of the die parts, substitution of different die parts and frequent inversion of the die assembly.

Another exemplary bin-back button making machine is taugth in U.S. Pat. No. 3,795,036. This reference teaches a four part die assembly. Again, however, during the pin-back button making process, the die parts must be assembled and disassembled a number of times, the die assembly must be inverted a number of times, and at least one die part requires inversion for two modes of use.

The present invention is based upon the discovery that a four part die assembly can be provided (to put together a pin-back button) which requires no inversion of the die assembly or parts thereof. Once the die assembly is loaded with the button front or shell, art work and protective cover, the die assembly need be opened during the button making process only once for insertion of the button back. These advantages are accomplished by providing selected ones of the die parts with lugs and the remainder of the die parts with cooperating lug-receiving slots which determine the depth to which each die part enters the die part on which it is mounted. The die parts are rotatable with respect to each other to align the various lugs with selected ones of the lug-receiving slots or the spaces therebetween. Each die part is provided with indicia means so that the die parts can be properly aligned with each other for each step of the button making process.

As a result, buttons can be more easily and quickly made by means of the die assembly of the present invention and the die assembly can be of simple construction and can be inexpensive to manufacture.

DISCLOSURE OF THE INVENTION

According to the invention there is provided a die assembly for the making of pin-back buttons. The die assembly is made up of four die parts: a base die part, a crimping die part, a ring die part and a top die part. These four die parts are mountable one upon the other in the order given, and each die part can be rotated with respect to the die part on which it is mounted.

The base die part is provided with a series of radially extending lugs, evenly spaced about its periphery. The crimping die part is provided with pairs of slots, the pairs being equal in number to the number of lugs on the base die part. Each pair of crimping die slots comprises a long slot and a short slot. As a result, the crimping die has three positions with respect to the base die part, depending upon its rotative position with respect to the base die part. The first position is one in which the crimping die part rests in an elevated position upon the tops of the base die part lugs. In a second position, the base die part lugs enter the short slots of the crimping die part, allowing the crimping die part to be lowered to an intermediate position with respect to the base die part. In the third rotative position of the crimping die part with respect to the base die part, the lugs of the base die part enter the long slots of the crimping die part, allowing the crimping die part to be fully seated with respect to the base die part.

In a similar fashion, the top die part is provided with a series of lugs evenly spaced about its periphery. The ring die part is provided with a cooperating set of identical slots evenly spaced about its periphery and equal in number to the number of top die part lugs. As a result, in one rotative position of the top die part with respect to the ring die part, the bottoms of the top die part lugs rest upon the upper surface of the ring die part. In a second rotative position of the top die part with respect to the ring die part, the lugs of the top die part enter the slots of the ring die part enabling the top die part to be fully seated in the ring die part.

Each die part is provided with indicia means so that all of the die parts can be properly rotatively aligned for each step of the button making process.

A second embodiment of the present invention is similar to the first with three basic exceptions. First of all, the top die part is provided with a magnet inset in its lowermost surface to enable the completed button to be more easily and conveniently removed from the die assembly. Secondly, means are provided to permanently connect the base die part and the crimping die part. Thirdly, means are provided in the base die part to bias the crimping die part to its uppermost position with respect to the base die part.

The use of the two embodiments of the die assembly of the present invention are substantially the same, as will be described hereinafter.

BRIEF DESCRIPTION OF THE DRAWINGS

FIGS. 13 through 17 are side elevational views of the die assembly, partly in cross section, and illustrating various stages of assembly of a pin-back button.

DETAILED DESCRIPTION OF THE INVENTION

Figure 1:
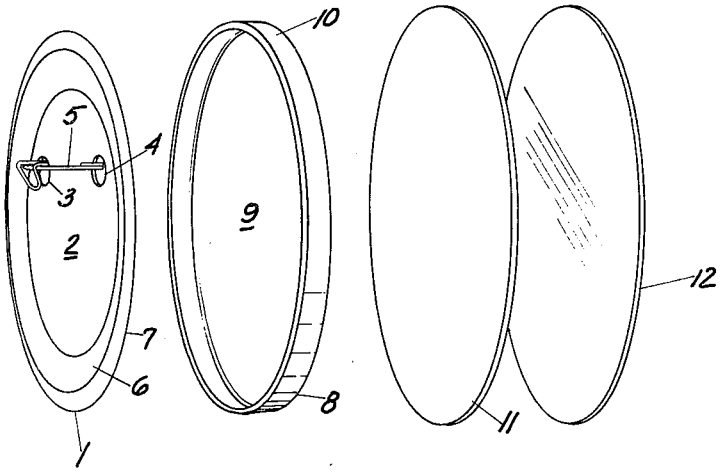
FIG. 1 is an exploded perspective view illustrating the basic part of a conventional pin-back button.

Reference is first made to FIG. 1 wherein the basic parts of a conventional pin-back button are illustrated. The button back is shown at 1 and comprises a circular member having a circular, planar, central portion 2. The portion 2 has a pair of perforations 3 and 4 formed therein. Mounted within perforations 3 and 4 there is a conventional pin 5 by means of which the button is affixed to the clothing or the like of the wearer. The central circular portion 2 is surrounded by an annular portion 6 which flares outwardly and rearwardly. The portion 6, in turn, terminates in an annular flange 7 which flares outwardly and forwardly (see also FIG. 5).

The button front or shell is shown at 8. The shell 8 comprises a circular, substantially planar portion 9 surrounded by a rearwardly extending flange 10. The button front or shell is normally also made of metal.

The button front or shell 8 is followed by the artwork the button is to bear. In this instance, the term "artwork" is intended to encompass a photograph, a printed picture, lettering or other appropriate indicia. The artwork comprises a thin circular member having a diameter greater than that of the button front or shell 8. To complete the button, a protective cover 12 is provided, having a diameter substantially equal to the diameter of the artwork 11. The protective cover 12 generally comprises a clear plastic member made of any appropriate material such as mylar or the like.

Figure 2:
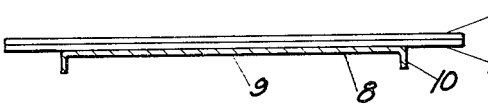
FIGS. 2 through 5 are cross sectional views illustrating the basic steps in assembling the conventional pin-back button.

The basic sequence in assembling a conventional pin-back button is illustrated in FIGS. 2 through 5. In FIG. 2, the button front or shell 8 is illustrated with its forward surface extending upwardly and its annular flange 10 extending downwardly. The button shell 8 is surmounted by the artwork 11 which, in turn, is surmounted by the protective cover 12. It will be apparent from FIG. 2 that the diameters of artwork 11 and protective cover 12 are greater than the diameter of button shell 8.

Figure 3:
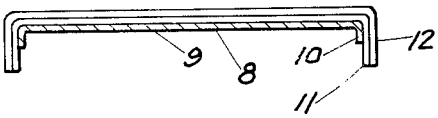
Figure 4:
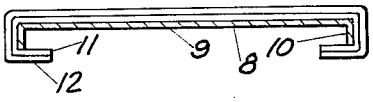

With the button shell 8, artwork 11 and protective cover 12 arranged as shown in FIG. 2, the next step is to crimp the peripheral portions of the artwork 11 and protective cover 12 downwardly along the button shell flange 10, as shown in FIG. 3. The next step is illustrated in FIG. 4. In this step, the peripheral portions of artwork 11 and protective cover 12 are further crimped inwardly as shown.

In the final step, the button back 1 is caused to enter the button shell. The peripheral edges of artwork 11 and protective cover 12 are wrapped about the flange 10 of shell 8. The flange 10 is crimped inwardly, locking the button back 1 in place.

Figure 6:
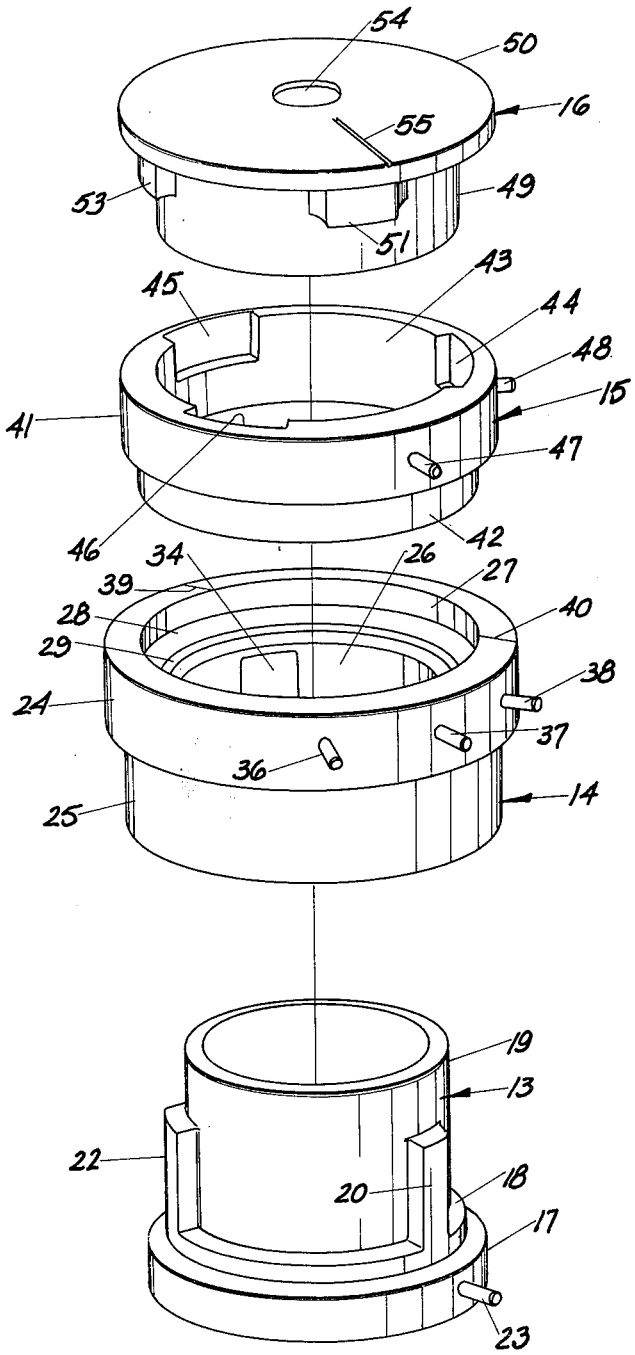
FIG. 6 is an exploded perspective view of a first embodiment of die assembly of the present invention.

The basic parts of a conventional pin-back button having been described and the basic steps of its assembly having been set forth, reference is now made to FIGS. 6 through 17 illustrating a first embodiment of the die assembly of the present invention by which a conventional pin-back button can be assembled. Like parts have been given like index numerals in these Figures and reference is first made to FIG. 6. In FIG. 6, the basic parts of the die assembly are shown in an exploded view. These parts comprise a base die part (generally indicated at 13), a crimping die part (generally indicated at 14), a ring die part (generally indicated at 15), and a top die part (generally indicated at 16). The die parts 13 through 16 may be made of metal (such as steel, aluminum or the like) or other material having sufficient hardness.

Figure 7:
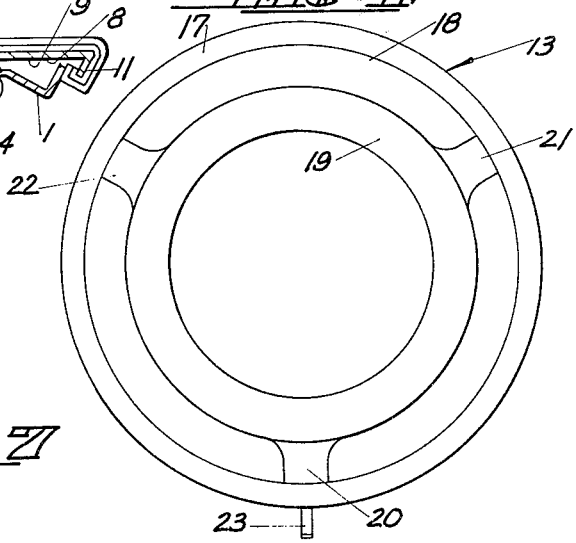
FIG. 7 is a top plan view of the base die part of FIG. 6.

Referring now to FIGS. 6 and 7, base die part 13 has a first circular bottom portion 17 surmounted by a second bottom portion 18 of slightly lesser diameter. The portion 18 supports a cylindrical wall 19 of lesser diameter than base portion 18. Cylindrical wall 19 is provided with three radially extending lugs 20, 21 and 22 evenly spaced thereabout. It will be apparent from FIG. 7 that the lugs 20 through 22 have forward edges coextensive with the peripheral edge of base portion 18. It will also be apparent from FIG. 6 that the lugs 20 through 22 are identical and extend upwardly for a distance less than the height of cylindrical wall 19. To complete the base die part 13, an indicia means is provided on base portion 17 opposite lug 20. While this indicia means may take any appropriate form, it is shown as constituting a roll pin 23 mounted in an appropriate bore in base portion 17 and extending radially thereof.

Figure 8:
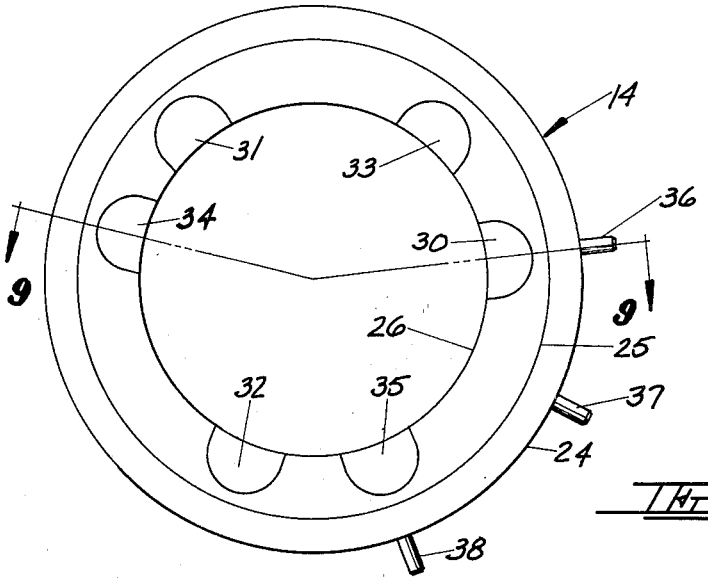
FIG. 8 is a bottom view of the crimping die part of FIG. 6.
Figure 9:
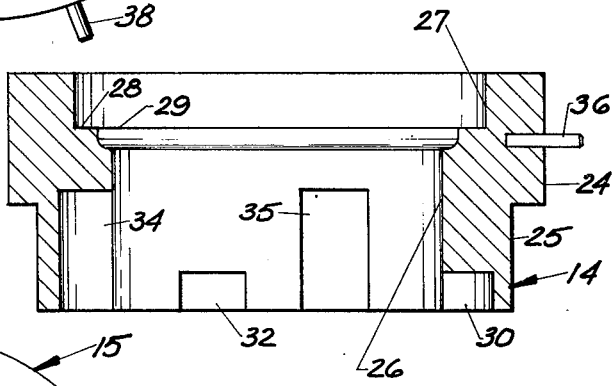
FIG. 9 is a cross sectional view taken along section line 9—9 of FIG. 8.

Reference is now made to FIGS. 6, 8 and 9. In these Figures, crimping die part 14 is shown. The crimping die part 17 constitutes a cylindrical member having an upper portion 24 and a lower portion 25, the upper portion 24 being of greater external diameter than the lower portion 25. The crimping die part 14 has a central bore portion 26 of such diameter as to just nicely receive the cylindrical wall 19 of base die part 13. Near its upper end, the crimping die part 14 has a second central bore portion 27 of greater diameter than bore portion 26. The diameter of second central bore portion 27 approximates that of the protective cover 12 and artwork 11 (see FIG. 1). An annular shoulder 28 is formed between the bore portions 26 and 27. Furthermore, between annular shoulder 28 and bore portion 26 there is an arcuate crimping surface 29.

Extending upwardly from the lower surface of crimping die part 14 there are a series of short slots 30, 31 and 32 formed in the inside surface of bore portion 26. Similarly, there is a series of long slots 33 through 35 formed in the same inside surface of bore portion 26. The short slots 30 through 32 and the long slots 33 through 35 are evenly spaced about the inside surface of bore portion 26. It will be further evident from FIG. 8 that the long and short slots are grouped in such a way that short slot 30 and long slot 33 are located near each other in parallel spaced relationship. Short slot 31 and long slot 34 are similarly grouped, as is short slot 32 and long slot 35.

To complete the crimping die part 14, it is provided with a series of alignment indicia which, again, can take any appropriate form. For purposes of an exemplary showing, the alignment indicia are illustrated in FIGS. 6 and 8 as constituting roll pins 36, 37 and 38 mounted in appropriate radial bores in the upper portion 24 of the crimping die part 14. It will be noted in FIG. 8 that pin 36 is aligned with short slot 30, pin 38 is aligned with long slot 35 and pin 37 is substantially centered with respect to the space therebetween. The crimping die part 14 is also provided with additional indicia means in the form of scribed lines 39 and 40 formed in its upper surface (see FIG. 6). The lines 39 and 40 are coextensive and their function will be described hereinafter.

Figure 10:
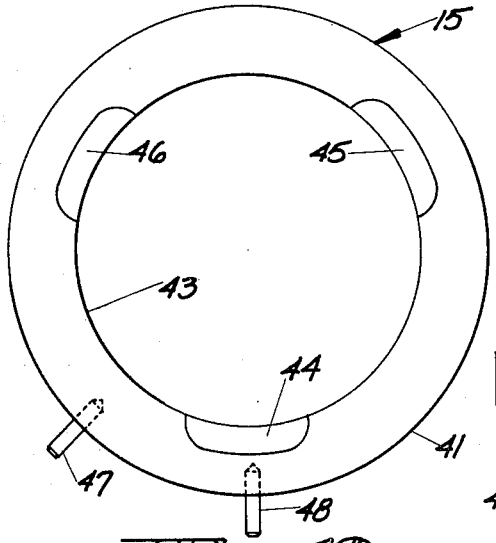
FIG. 10 is a top plan view of the ring die part of FIG. 6.
Figure 11:
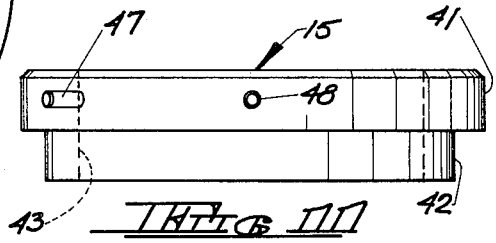
FIG. 11 is an edge elevational view of the ring die part of FIGS. 6 and 10.

The ring die part is illustated in FIGS. 6, 10 and 11. The ring die part 15 comprises a cylindrical member having an upper portion 41 and a lower portion 42, the upper portion being of greater external diameter than the lower portion. Ring die part 15 has a central bore 43 of a diameter substantially equal to the maximum diameter of arcuate crimping surface 29 of crimping die part 14. The lower portion 42 of ring die part 15 has an external diameter such that it can just nicely be received in upper bore portion 27 of crimping die part 14. The ring die part 15 has a series of identical slots 44, 45 and 46 formed in the inside surface of bore 43 and evenly spaced thereabout. As is evident from FIG. 6, the slots 44, 45 and 46 extend downwardly from the upper surface of ring die part 15.

To complete ring die part 15, once again alignment indicia are provided. These can take any appropriate form, but for purposes of this exemplary showing they are again illustrated as constituting roll pins 47 and 48, radially mounted in appropriate bores in the upper portion 41 of the ring die part 15. It should be noted in FIG. 10 that pin 48 is aligned with slot 44 and pin 47 is aligned at any appropriate position between slots 44 and 46.

Figure 12:
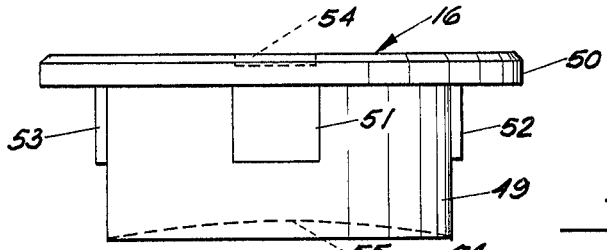
FIG. 12 is a side elevational view of the top die part of FIG. 6.

The die assembly is completed by top die part 16 shown in FIGS. 6 and 12. The top die part 16 comprises a solid cylindrical body part 49 surmounted by an upper portion 50 of greater diameter. The upper die part 16 is provided with a series of lugs 51, 52 and 53 evenly spaced about the periphery of body portion 49. The lugs 51, 52 and 53 are identical and extend downwardly from upper portion 50. The lugs 51 through 53 are so sized as to be receivable within the slots 44 through 46 of ring die part 15. The upper surface of top die portion 50 is provided with a circular depression 54 adapted to receive the plunger of a hand or bench press, as will be described hereinafter. To complete die part 16, an alignment indicia means is provided in the form of a score line 55 in the upper surface of the top die part, aligned with lug 51. It will be evident from FIG. 12 that the bottom surface 55*a* of top die part 16 is slightly concave.

Figure 13:
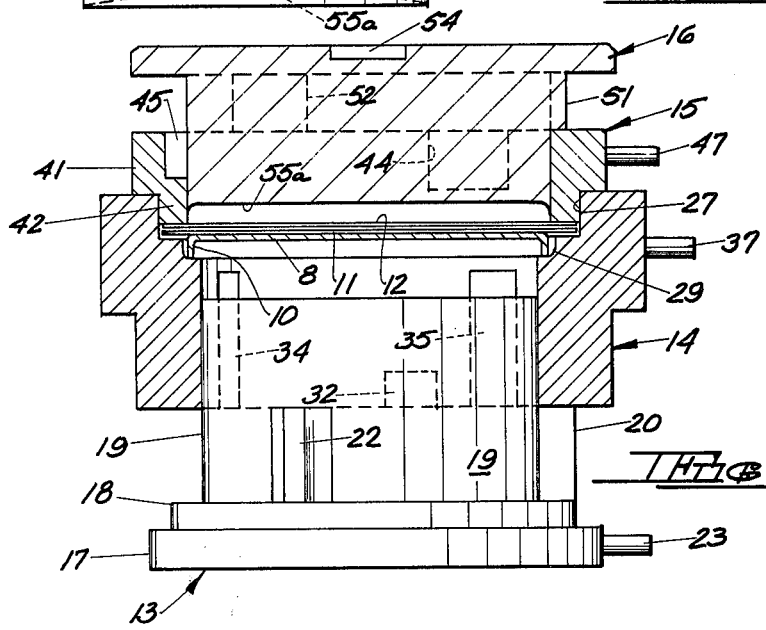

The die parts of the embodiment of FIG. 6 having been described in detail, the manner in which these die parts are employed to assemble a conventional pin-back button will next be described with reference to FIGS. 13 through 17, wherein like parts have been given like index numerals. Reference is first made to FIG 13. To assemble a button, base die part 13 is first located on an appropriate surface. Thereafter, crimping die part 14 is mounted on base die part 13 with its locating pin 37 in alignment with the locating pin 23 of base die part 13. This assures that each of the base die part lugs 20, 21 and 22 are located between the short and long crimping die slots 30–35, 32–34 and 31–33, respectively. As a result, the crimping die part 14 rests in its uppermost position on top of base die part lugs 20, 21 and 22, as shown.

Into the crimping die part 14 a button front or shell 8 is located with its rearward flange 10 extending downwardly. On top of shell 8 an artwork piece 11 is placed together with a protective cover piece 12. Thereafter, ring die part 15 is mounted in crimping die part 14 with the lower body portion 42 of ring die part 15 received within the bore portion 27 of crimping die part 14. The alignment pin 47 of ring die part 15 is aligned with alignment pin 37 of crimping die part 14, with the result that all of pins 47, 37 and 23 are in vertical alignment. To assure proper orientation of artwork member 11, the bottom of the artwork should be aligned with pin 37 of crimping die part 14.

Thereafter, top die part 16 is located on ring die part 15 with its alignment mark 55 aligned with pin 47 of ring die part 15.

Figure 14:
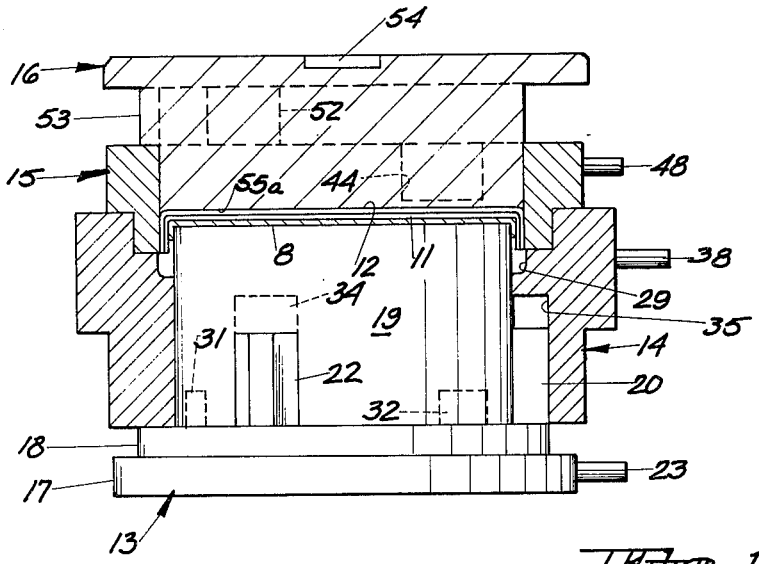
Figure 1D:
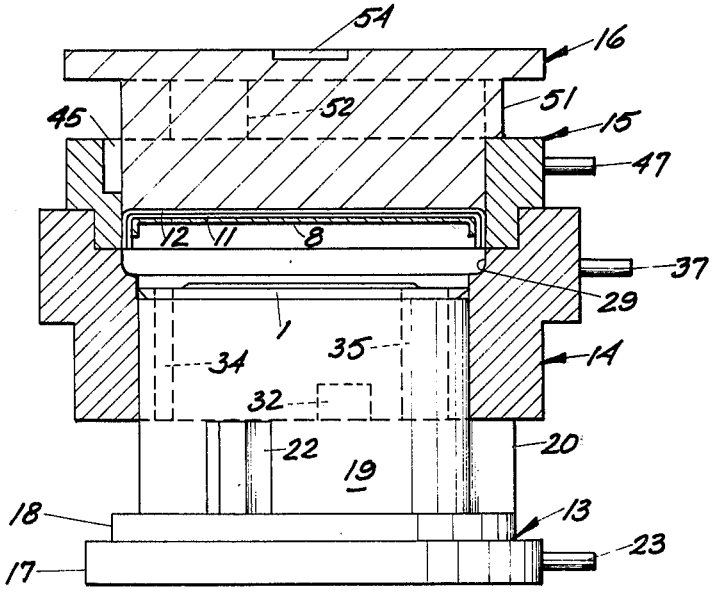
Figure 1E:
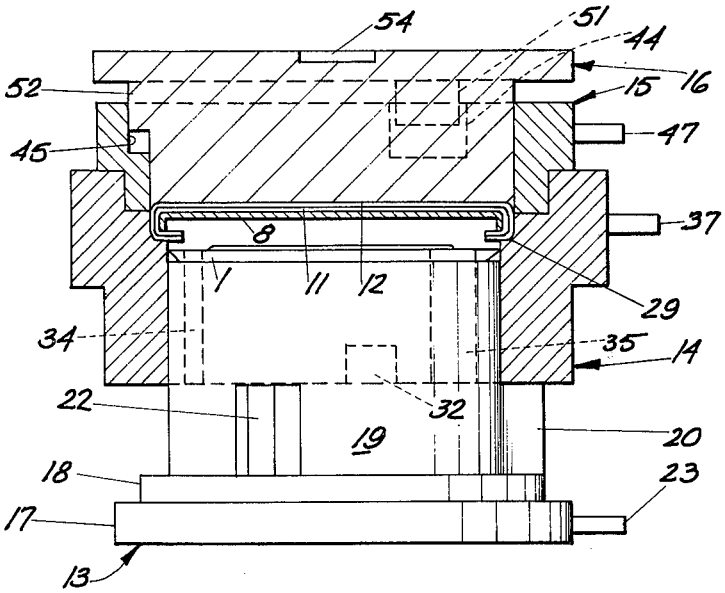

At this point, the operator places the palm of his hand on the upper surface of top die part 16 and grasps crimping die part 14 with its thumb and fingers. While holding the crimping die part 14, ring die part 15 and top die part 16 tightly together in this fashion, this entire assembly is turned clockwise with respect to base die part 13 until pin 38 of crimping die part 14 is in alignment with pin 23 of base die part 13. This movement locates the long crimping die slots 35, 34 and 33 over base die part lugs 20, 21 and 22, respectively. A downward push of the crimping die part, ring die part and top die part assembly results in this assembly shifting downwardly with respect to base die part 13 until the lower surface of crimping die part 14 rests upon base portion 18. This is illustrated in FIG. 14. It will be noted in FIG. 14 that protective cover 12, artwork 11 and button shell 8 are all now completely located within ring die part 15, having been shoved to this location by the upper surface of cylindrical wall 19 of base die part 13. As a result of this action, the peripheral portions of protective cover 12 and artwork 11 have been crimped downwardly along the downwardly extending flange 10 of button shell 8 in the same manner illustrated in FIG. 3. At this point, the first step in the assembly of the pin-back button has been accomplished.

Thereafter, the assembly of the crimping die part 14, ring die part 15 and to die part 16, still being grasped firmly together, is lifted and rotated counter-clockwise until the alignment pin 37 of crimping die part 14 is aligned with base die pin 23. Once again, crimping die part 14 rests on the upper ends of base die part lug 20, 21 and 22 in its elevated position, as shown in FIG. 15. At this point, the top die part 16 and the ring die part 15 are removed as a unit from crimping die part 14 and a button back 1 is located (pin-down) in the crimping die part 14 and on top of the upper edge of the cylindrical wall 19 of base die part 13. To assure proper orientation of the artwork on the button when worn, the pin of the button back is aligned with the indicia marks 39 and 40 (see FIG. 6) on the upper surface of crimping die part 14. Thereafter, the top die part 16 and ring die part 15 are replaced on the crimping die part 14 with ring die part pin 47, crimping die part pin 37 and base die part pin 23 in alignment. The die assembly at this point is illustrated in FIG. 15. It will be noted (as pointed out above) that button shell 8, artwork 11 and protective cover 12 are located wholly within the confines of ring die part 15. FIG. 15 also shows the button back 1 mounted on the base die part 13 within crimping die part 14.

To accomplish the next step in the pin-back button assembly procedure (i.e., that step illustrated in FIG. 4), top die part 16 is rotated on ring die part 15 until the indicia mark 55 of top die part 16 is aligned with pin 48 of ring die 15. This assures that the lugs 51, 52 and 53 are aligned with slots 44, 45 and 46, respectively, of the ring die part 15. A firm pressure is applied to the top die part 16 with the heel of the operator's hand until the top die part 16 drops completely into the ring die part 15, as shown in FIG. 16. This shoves button shell 8, artwork 11 and protective cover 12 out of ring die 15 and completely into crimping die 14. The action of arcuate crimping surface 29 causes the peripheral portions of artwork 11 and protective cover 12 to be crimped about shell flange 10 in the manner shown both in FIGS. 4 and 16.

Figure 5:
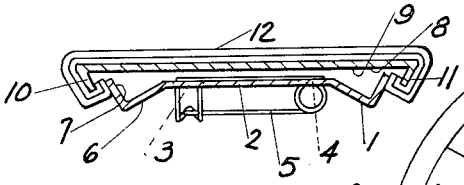
Figure 17:
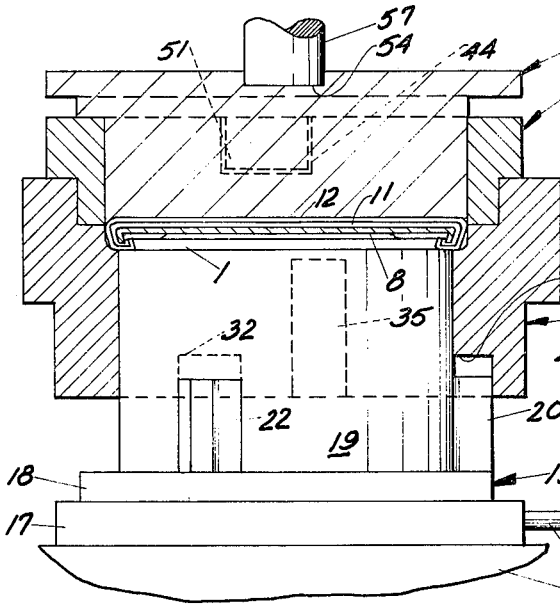

To perform the final step illustrated in FIG. 5, the top die part 16, ring die part 15 and crimping die part 14 are again grasped as a unit and rotated in a counter-clockwise direction so that pin 36 of the crimping die part is aligned with pin 23 of base die part 13. This aligns the short slots 30, 31 and 32 over lugs 20, 22 and 21, respectively of base die part 13. As a result of this, the assembly of the crimping die part 14, ring die part 15 and top die part 16 is permitted to drop downwardly with respect to base die part 13, causing button back 1 to enter the assembly of the button shell 8, bending the peripheral portions of artwork 11 and protective cover 12 around shell flange 10, as shown in FIG. 17. Maintaining the die parts in the orientation shown in FIG. 17, the entire die assembly is located within a hand or bench press, with the base die part 13 resting on the base portion 56 of the press (fragmentarily shown in FIG. 17) and the press plunger 57 (again fragmentarily shown in FIG. 17) inserted in depression 54 of top die part 16. The hand or bench press is then actuated, pressing the die parts together to crimp shell flange 10 inwardly to lock button back 1 in place. The hand or bench press is not fully illustrated since such presses are well known in the art and do not constitute a part of the present invention.

At this point, the die assembly is removed from the hand or bench press and the top die part 16 and ring die part 15 are removed from the crimping die part 14. The crimping die part is rotated so that its alignment pin 38 is aligned with pin 23 of base die part 13. This places long slots 33, 34 and 35 in alignment with their respective ones of base die part lugs 20 through 22 enabling the crimping die part to be shifted downwardly against base portion 18 of base die part 13 (i.e., the same position shown in FIG. 14). This will cause the upper end of cylindrical wall 19 of base die part 13 to remove the completed button from the crimping die part 14. At this point the pin-back button assembly procedure is complete and the die assembly can be reloaded in the manner described with respect to FIG. 13 to assemble another pin-back button. It is within the scope of the present invention to color code the die parts 13, 14, 15 and to similarly color code alignment pins 23, 36, 37, 38, 47 and 48 to facilitate the use of the die assembly.

FIGS. 18 through 22 illustrate a second embodiment of the present invention. The second embodiment is similar to the first and like parts have been given like index numerals. Referring first to FIG. 18, again the die assembly is made up of a base die part (generally indicated at 13*a*), a crimping die part (generally indicated at 14*a*), a ring die part (generally indicated at 15*a*), and a top die part (generally indicated at 16*a*).

Figure 18:
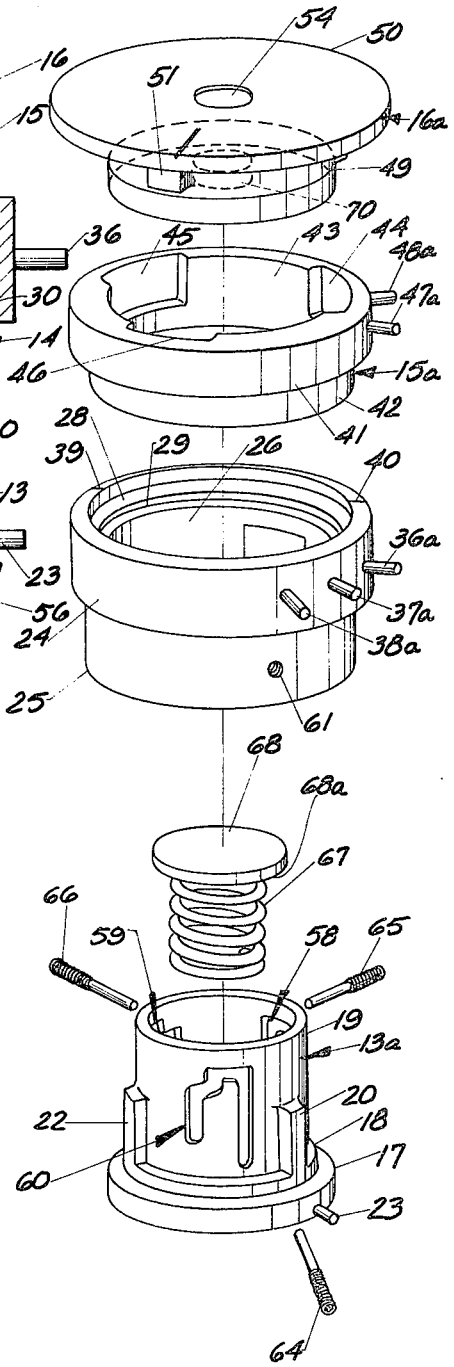
FIG. 18 is an exploded perspective view of a second embodiment of the die assembly of the present invention.
Figure 19:
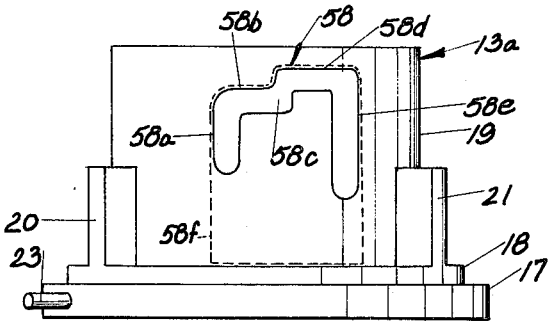
FIG. 19 is a side elevational view of the base die part of FIG. 18.

Referring now to FIGS. 18 and 19, base die part 13*a* is substantially identical in configuration to base die part 13 of FIG. 6, having a first base portion 17, a second base portion 18 and three identical vertical lugs 20, 21 and 22 extending radially from a cylindrical wall 19. Again, base portion 17 is provided with an alignment pin 23.

Base die part 13*a* differs from base die part 13 of FIGS. 6 and 7 in that between each adjacent pair of lugs 20–21, 21–22, 22–20, there is located an identical slot formed in cylindrical wall 19. In FIG. 19, the slot between lugs 20 and 21 is generally indicated at 58. Slot 58 comprises a first short vertical portion 58*a*, followed by a first horizontal portion 58*b*. Horizontal portion 58*b* is followed by an intermediate vertical portion 58*c*, leading to a second horizontal portion 58*d*. Horizontal slot portion 58*d* terminates in a long vertical portion 58*e*. As indicated above, the other two slots, generally indicated at 59 and 60 in FIG. 18, are identical to slot 58. The purpose of these slots will be apparent hereinafter.

Crimping die part 14*a* is again substantially identical to crimping die part 14 of FIG. 6 and like parts have been given like index numerals. Crimping die part 14*a* differs from crimping die part 14 of FIG. 6 in only two respects: the addition of means to connect the crimping die part 14*a* to the base die part 13*a* and the arrangement of the indicia means. First of all, the lower body portion 25 of crimping die part 14*a* is provided with three evenly spaced, radially extending bores 61, 62 and 63 (see FIG. 20). Mounted within these bores are pins, such as roll pins 64, 65 and 66, respectfully. It will be apparent from FIG. 20 that roll pins 64 through 66 extend radially inwardly of bore portion 26.

Figure 20:
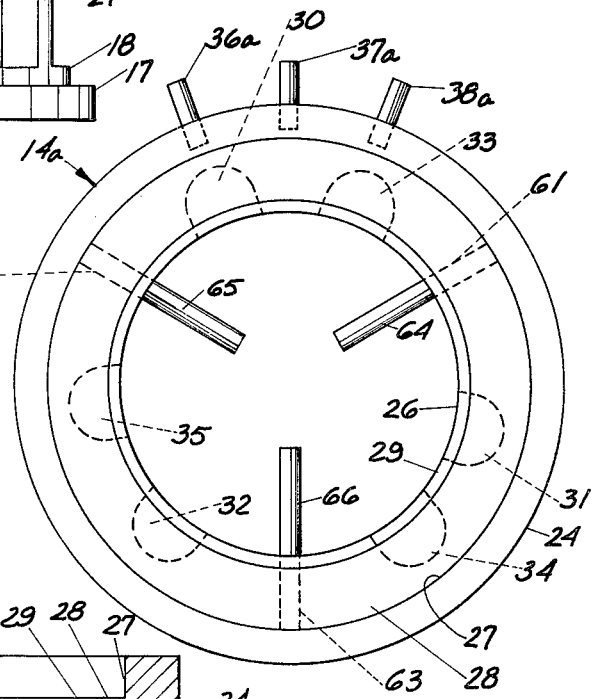
FIG. 20 is a top plan view of the crimping die part of FIG. 18.
Figure 21:
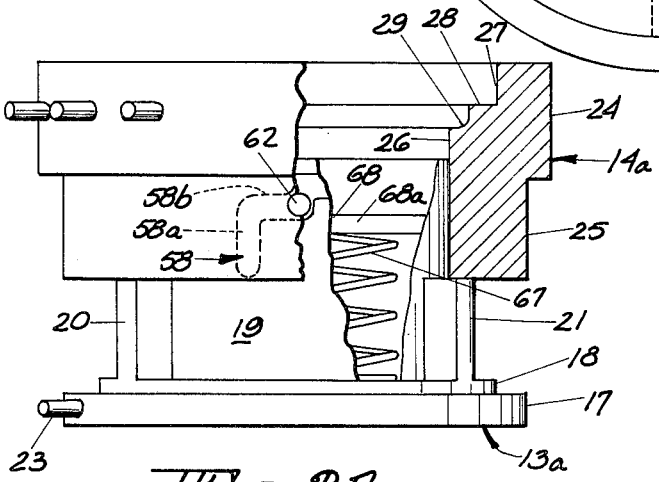
FIG. 21 is a fragmentary side elevational view, partly in cross section, illustrating the assembly of the base die part and the crimping die part of FIG. 18.
Figure 22:
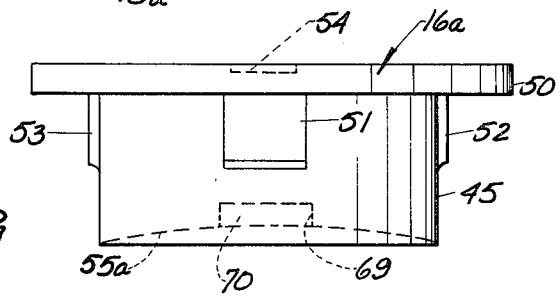
FIG. 22 is a side elevational view of the top die part of FIG. 18.

The assembly of base die part 13*a* and crimping die part 14*a* is illustrated in FIG. 21. Referring to this figure together with FIGS. 18 and 20, the crimping die part 14*a* is mounted on base die part 13*a* and then roll pins 64 through 66 are inserted in their respective perforations 61 through 63 in crimping die part 14*a*. The roll pins 64, 65 and 66 extend through slots 60, 58 and 59, respectively, in cylindrical wall 19 of base die part 13*a*. This renders crimping die part 14*a* captive on base die part 13*a*.

Prior to the mounting of crimping die part 14*a* on base die part 13*a*, a coiled compression spring 67 is located within the cylindrical wall 19 of base die part 13*a*, together with a spring seat 68 comprising a circular disk-like member having a downwardly depending peripheral flange 68*a*. After assembly of the crimping die part 14*a* and the base die part 13*a*, the lower end of spring 67 abuts the base portion 18 of base die part 13*a* within wall 19 and the upper end of spring 67 abuts spring seat 68. The spring seat 68, in turn, abuts those ends of roll pins 64, 65 and 66 extending within cylindrical wall portion 19. Thus, not only is crimping die part 14*a* captively mounted on base die part 13*a*, but also it is always biased to an upper position wherein the roll pin 65 lies within horizontal portions 58*b* or 58*d* of slot 58, depending upon the rotative position of the crimping die part 14*a* with respect to base die part 13*a*, the other roll pins 64 and 66 being located in similar portions of their respective slots 60 and 59. This permanent joining of crimping die part 14*a* and base die part 13*a* and the spring biasing of crimping die part 14*a* upwardly, is not only a matter of convenience to the person using the die assembly, but also eliminates certain manipulative steps, as will be described hereinafter.

The second respect with which crimping die part 14*a* differs from crimping die part 14 of FIG. 6 lies in the fact that the spacing of indicia or alignment pins 36*a*, 37*a* and 38*a* differs from the positioning of alignment pins 36, 37 and 38 of FIG. 6. This can be explained as follows. Comparing FIGS. 8 and 20, it will be noted that the arrangement of short slots 30, 31 and 32 and the arrangement of long slots 33, 34 and 35 of crimping die parts 14 and 14*a* are identical. In both embodiments of the crimping die part, the short and long slots are arranged in evenly spaced pairs, 30–33, 31–34 and 32–35. In the embodiment of FIG. 16, the lugs 20, 21 and 22 of base die part 13 each cooperate with a long slot of one pair, a short slot of an adjacent pair and the space therebetween to determine the fully seated, intermediate and upper positions of crimping die part 14. In the embodiment of FIG. 18, however, the lugs 20, 21 and 22 of base die part 13*a* each cooperate with the long and short slots of the same pair and the intermediate space between the long and short slots of the same pair to determined the fully seated, intermediate and upper positions of crimping die part 14*a*. This being the case, a repositioning of indicia or alignment pins is required, as shown in FIGS. 18 and 20 at 36*a*, 37*a* and 38*a*. It will be understood by one skilled in the art that the same arrangement of cooperation between the long and short slots of the crimping die part and the lugs of the base die part could have been used in the embodiment of FIG. 6 without changing the basic operation of the die assembly illustrated in that Figure.

The ring die part 15*a* of the embodiment of FIG. 18 is substantially identical to ring die part 15 of the embodiment of FIG. 6 and like parts have been given like index numerals. The only difference between ring die part 15*a* and ring die part 15 lies in the spacing of the indicia or alignment pins, pin 48*a* of ring die part 15*a* occupying the same position as pin 48 of ring die part 15, while the pin 47*a* is moved slightly closer to pin 48*a* in ring die part 15*a* than is pin 47 in ring die part 15. This is necessitated by virtue of the different alignment of pins 36*a*, 37*a* and 38*a* in crimping die part 14*a*. This same spacing of alignment pins could be provided with respect to alignment pins 47 and 48 of ring die part 15 of FIG. 6, if desired.

Top die part 16*a* is identical to top die part 16 with the exception that a central depression 69 is formed in the concave surface 55 of top die part 16*a* to accommodate a magnet 70. The magnet 70 enables removal of the completed pin-back button from the die assembly of FIG. 18 by simple lifting of top die part 16*a*.

The operation of the embodiment of FIG. 18 in making a pin-back button is substantially the same as that described for the embodiment of FIG. 6, with respect to FIGS. 13 through 17. The only difference lies in the fact that certain manipulative steps can be eliminated in the use of the embodiment of FIG. 18. For example, the loading procedure described with respect to FIG. 13 is the same for the embodiment of FIG. 18 with the exception that the crimping die part 14*a* can be from the outset so aligned with respect to base die part 13*a* that the base die part lugs 20 through 22 are under the long slots 33, 34 and 35 of crimping die part 14*a* by alignment of crimping die part indicia pin 38*a* with base die part indicia pin 23. Spring 67 will maintain crimping die part 14*a* in its elevated position during loading until such time as pressure is applied to top die part 16*a* to achieve the first step illustrated in FIG. 14. This then eliminates the necessity of initially assuring that the crimping die part 14*a* is supported on the tops of the base die part lugs 20 through 22 (as in the case of FIG. 13) and the necessity of rotating the assembly of the crimping die part 14*a*, the ring die part 15*a* and the top die part 16*a* as a unit to perform the step illustrated in FIG. 14. At the end of the button making procedure (illustrated in FIG. 17), it is only necessary in the use of the embodiment of FIG. 18 to lift top die 16*a* from the die assembly. By virtue of magnet 70, the completed button will adhere to the bottom surface of top die 16 and can be easily slid therefrom.

As in the embodiment of FIG. 6, it is within the scope of the invention to color code the die parts 13*a*, 14*a*, 15*a* and 16*a* of the embodiment of FIG. 18 and to color code the various alignment pins 23, 36*a*, 37*a*, 38*a*, 47*a* and 48*a*.

Modifications may be made in the invention without departing from the spirit of it. For example, it would be within the scope of the invention to captively mount top die part 16*a* on ring die part 15*a* in any appropriate manner. Furthermore, it is within the scope of the invention to substitute a simple opening for the slots 58, 59 and 60. Such an opening is shown in broken lines 58*f* in FIG. 19.

It will be understood by one skilled in the art that the lugs and slots taught herein could be replaced by posts and cooperating bores to accomplish the same purposes. Furthermore, the bottom die part and the top die part could be provided with slots or bores and the crimping die part and the ring die part could be provided with lugs or posts.

The top die part and the ring die part could be replaced by any appropriate single piece part or multiple piece part which would cooperate with the base die part and crimping die part to make the initial fold in the peripheral parts of the artwork 11 and protect cover 12 and which would apply pressure to said button parts in said crimping die part.

What is claimed is:

1. A die assembly for the making of pin-back buttons of the type comprising a button back, a button shell, art work and a protective cover, said die assembly comprising a base die part, a crimping die part, a ring die part and a top die part, said die parts being mountable one upon the other in the order given, cooperating means on said base die part and said crimping die part and on said ring die part and said top die part determine the depth to which said base die part enters said crimping die part and said top die part enters said ring die part, said die parts each being rotatable with respect to that die part on which it is mounted to bring selected ones of said cooperating means into and out of registry to enable each die part to perform its functions in proper sequence.

2. The structure claimed in claim 1 including means to captively join said crimping die part to said base die part.

3. The structure claimed in claim 1 wherein said cooperating means comprise lugs on a selected one of said base die part and said crimping die part and on a selected one of said ring die part and said top die part and lug-receiving slots on the remaining ones of said die parts.

4. A die assembly for making pin-back buttons of the type comprising a button back, a button shell, art work and a protective cover, said die assembly comprising a base die part, a crimping die part, and die part means to initially fold said artwork and said protective cover and to apply pressure to said button parts in said crimping die part, said die parts being mountable one upon the other in the order given, said crimping die part being rotatable with respect to said base die part, said base die part comprising a base portion, a cylindrical wall portion mounted on said base portion and terminating in an annular upper end, said crimping die comprising a cylindrical member having upper and lower annular ends and having a lower axial bore portion of an internal diameter such as to just nicely receive said cylindrical wall portion of said base die part and an upper axial bore portion of greater diameter than said lower bore portion, an annular shoulder formed between said bore portions, the innermost edge of said shoulder terminating in an arcuate downwardly and inwardly extending annular crimping surface, cooperating means on said base die part and said crimping die part to determine the depth to which said base die part enters said crimping die part depending upon the rotative position of the crimping die part with respect to said base die part.

5. The structure claimed in claim 4 including means to captively join said crimping die part to said base die part.

6. The structure claimed in claim 4 wherein said cooperating means on said base die part and said crimping die part comprise lugs on a selected one of said base die part and said crimping die part and lug-receiving slots on the other of said base die part and said crimping die part.

7. The structure claimed in claim 4 wherein said means to initially fold said artwork and said protective cover and to apply pressure to said button parts in said crimping die part comprise a ring die part and a top die part, said ring die comprising a cylindrical member having a lower portion of such outside diameter as to be just nicely received in said upper bore portion of said crimping die part and having a lower annular end adapted to seat on said crimping die part shoulder, said ring die having an upper portion terminating in an upper annular end, said ring die part having an axial bore, said top die part comprising a cylindrical member having a lower body portion of such outside diameter as to be just nicely receiving in said ring die part bore and terminating in a bottom surface, said top die part having an upper body portion terminating in a flat top surface, cooperating means on said ring die part and said top die part to determine the depth to which said top die part enters said ring die part.

8. The sturcture claimed in claim 7 including a magnet in said top die part, said magnet being flush with said top die part bottom surface.

9. The structure claimed in claim 7 wherein said cooperating means on said ring die part and said top die part comprise lugs on a selected one of said ring die part and said top die part and lug-receiving slots on the other of said ring die part and said top die part.

10. A die assembly for making pin-back buttons of the type comprising a button back, a button shell, artwork and a protective cover, said die assembly comprising a base die part, a crimping die part, a ring die part and a top die part, said die parts being mountable one upon the other in the order given, each die part being rotatable with respect to that die part on which it is mounted, said base die part comprising a base portion, a cylindrical wall portion mounted on said base portion and terminating in an annular upper end, a set of identical integral vertical lugs evenly spaced about said cylindrical wall portion and extending from said base portion substantially halfway up said cylindrical wall portion, said crimping die part comprising a cylindrical member having upper and lower annular ends and having a lower axial bore portion of an internal diameter such as to just nicely receive said cylindrical wall portion of said base die part and an upper axial bore portion of greater diameter than said lower bore portion, an annular shoulder formed between said bore portions, the innermost edge of said shoulder terminating in an arcuate downwardly and inwardly extending crimping surface, said crimping die part having a first set of short slots evenly spaced about the inside surface of said lower bore portion and extending vertically from said lower annular end thereof, said bottom die part lugs being receivable in said short slots, said crimping die part having a second set of long slots evenly spaced about the inside surface of said lower bore portion and extending vertically from said lower annular end thereof, said bottom die part lugs being receivable in said long slots, said ring die comprising a cylindrical member having a lower portion of such outside diameter as to be just nicely received in said upper bore portion of said crimping die part and having a lower annular end adapted to set on said crimping die part shoulder, said ring die having an upper portion of an outside diameter greater than said lower portion thereof and terminating in an upper annular end, said ring die part having an axial bore, said ring die part having a set of slots evenly spaced about the inside surface of the axial bore thereof and extending vertically downwardly from said upper annular end thereof about half the length of said ring die part bore, said top die part comprising a cylindrical member having a lower body portion of such outside diameter as to be just nicely received in said ring die part bore and terminating in a bottom surface, said top die part having an upper body portion of greater diameter than its lower body portion and terminating in a flat top surface, said top die part having a set of integral lugs evenly spaced about the exterior surface of said lower body portion thereof and extending vertically from the upper body portion thereof about half the height of said lower body portion thereof, said top die part lugs being receivable in said ring die part slots.

11. The structure claimed in claim 10 wherein said top die part has a first rotative position with respect to said ring die part wherein said top die part lugs rest on said upper annular surface of said ring die part and said bottom surface of said top die part is located within said ring die part, said top die part having a second rotative position with respect to said ring die part wherein said top die part lugs enter said ring die part slots and said bottom surface of said top die part lies about even with said crimping die part shoulder.

12. The structure claimed in claim 10 including a magnet in said top die part, said magnet being flush with said top die part bottom surface.

13. The structure claimed in claim 10 wherein said top die part has a central depression in its top surface for receipt of the plunger of a press.

14. The structure claimed in claim 10 wherein said long and short slots of said crimping die part are arranged in pairs evenly spaced about said inside surface of said lower bore portion, each pair comprising one long and one short slot, said crimping die part having a first rotative position with respect to said base die part wherein said base die part lugs contact and support said lower surface of said crimping die part between said pairs of slots and said upper annular end of said base die part cylindrical wall lies within said lower bore portion below said annular crimping surface, said crimping die part having a second rotative position with respect to said base die part wherein said base die part lugs are located within said long slots and said upper annular end of said cylindrical wall lies above said crimping die part shoulder, said crimping die part having a third rotative position with respect to said base die part wherein said base die part lugs are located in said short slots and said upper annular end of said cylindrical wall lies just below said annular crimping surface.

15. The structure claimed in claim 10 wherein said long and short slots of said crimping die part are arranged in pairs evenly spaced about said inside surface of said lower bore portion, each pair comprising one long and one short slot, said crimping die part having a first rotative position with respect to said base die part wherein said base die part lugs contact and support said lower surface of said crimping die part between said slots of each pair thereof and said upper annular end of said base die part cylindrical wall lies within said crimping die part lower bore portion below said annular crimping surface, said crimping die part having a second rotative position with respect to said base die part wherein said base die part lugs are located within said long slots and said upper annular end of said cylindrical wall lies above said crimping die part shoulder, said crimping die part having a third rotative position with respect to said base die part wherein said base die part lugs are located in said short slots and said upper annular end of said cylindrical wall lies just below said annular crimping surface of said crimping die part.

16. The structure claimed in claim 10 including means to captively join said crimping die part to said base die part.

17. The structure claimed in claim 11 including indicia means on said top die part and on said ring die part to assist in achieving said first and second positions of said top die part with respect to said ring die part.

18. The structure claimed in claim 14 including indicia means on said crimping die part and on said base die part to assist in achieving said first, second and third positions of said crimping die part with respect to said base die part.

19. The structure claimed in claim 15 including indicia means on said crimping die part and on said base die part to assist in achieving said first, second and third positions of said crimping die part with respect to said base die part.

20. The structure claimed in claim 15 including identical slots formed in said cylindrical wall portion of said base die part between adjacent ones of said base die part lugs, a set of pins mounted on said crimping die part, said pins being equal in number to said cylindrical wall portion slots, each of said pins extending radially inwardly of said crimping die part lower bore portion and through one of said slots in said cylindrical wall portion, said cylindrical wall portion slots each being so configured as to cooperate with its respective pin to permit said crimping die part to achieve its first, second and third positions with respect to base die part, said cylindrical wall portion slots and said pins cooperating to render said crimping die part captive on said base die part.

21. The structure claimed in claim 20 including a coiled compression spring mounted within said cylindrical wall portion of said base die part, said spring having a lower end abutting said base portion of said base die part, said spring having an upper end, a spring seat means mounted on said upper spring end and being in abutment with said crimping die part pins.

* * * * *